United States Patent [19]

Masaki

[11] 4,292,946

[45] Oct. 6, 1981

[54] AIR-FUEL RATIO CONTROL SYSTEM

[75] Inventor: Kenji Masaki, Yokohama, Japan

[73] Assignee: Nissan Motor Company, Limited, Yokohama, Japan

[21] Appl. No.: 82,337

[22] Filed: Oct. 5, 1979

[30] Foreign Application Priority Data

Nov. 15, 1978 [JP] Japan ..... 53-140667
Nov. 15, 1978 [JP] Japan ..... 53-140668

[51] Int. Cl.[3] ..... F02B 33/00
[52] U.S. Cl. ..... 123/440; 123/489
[58] Field of Search ..... 60/279, 285; 123/440, 123/489, 32 EE, 119 EC

[56] References Cited

U.S. PATENT DOCUMENTS 3,825,239 7/1974 Rice ..... 123/119 EC
3,861,366 1/1975 Masaki ..... 123/119 EC
4,056,932 11/1977 Nakamura ..... 123/119 EC

FOREIGN PATENT DOCUMENTS 1043717 5/1957 Fed. Rep. of Germany ..... 60/285
1365979 9/1974 United Kingdom .
1488956 10/1977 United Kingdom .
1547353 11/1977 United Kingdom .
1528054 10/1978 United Kingdom .

*Primary Examiner*—Ronald B. Cox
*Attorney, Agent, or Firm*—Schwartz, Jeffery, Schwaab, Mack, Blumenthal & Koch

[57] ABSTRACT

An air-fuel ratio control system is disclosed for use with a carburettor including an air-fuel induction passage provided therein with a throttle valve. The system comprises a control circuit responsive to various engine operating factors for deriving an engine operating condition and providing a pulse signal having a constant period and a pulse width corresponding to the derived engine operating condition, fuel supply means for supplying fuel, a fuel passage connected at its one end to the fuel supply means and at the other end to the induction passage downstream of the throttle valve, and a control valve provided in the fuel passage, the control valve responsive to the pulse signal from the control circuit for controlling the flow of fluid passing therethrough thereby providing an optimum air-fuel ratio corresponding to the engine operating condition.

5 Claims, 4 Drawing Figures

AIR-FUEL RATIO CONTROL SYSTEM

BACKGROUND OF THE INVENTION

1. Field of the Invention

This invention relates to an air-fuel control system for use with an engine carburettor and, more particularly, to an air-fuel control system responsive to various engine operating factors for controlling the air-fuel ratio of a mixture supplied to the engine according to engine operating conditions.

2. Description of the Prior Art

It has been considered preferable to maintain the air-fuel ratio of a mixture supplied to an internal combustion engine at the stoichiometric level. In terms of higher engine operating stability, however, the air-fuel ratio should be controlled in accordance with the condition under which the engine is operating. For this purpose, carburettors have been required to have the following functions:

During engine starting operation, the requisite functions are (1) to supply a rich mixture to permit the engine to start even at 30° C., (2) to rarefy the mixture to a suitable fuel density after perfect explosion, (3) to permit the engine to run at high speed so as to prevent the engine from stalling after the engine starts, and (4) to gradually rarefy the mixture as the engine is warmed up. The function (1) has been accomplished by means of a choke valve and a valve operating bimetal, the function (2) by means of a perfect explosion diaphragm mechanism, the function (3) by means of a fast idle mechanism, and the function (4) by means of a heater for heating the choke valve operating bimetal.

During engine warming-up operation, the requisite functions are (1) to gradually reduce the speed of rotation of the engine to an idling level as the engine is warmed up, (2) to enrich the mixture if the engine is rapidly accelerated, (3) to permit high drivability even if the vehicle runs just after engine starting operation, and (4) to open the choke valve after the engine is warmed up for fuel economy. The function (1) has been accomplished by means of an unloader mechanism, the function (2) by means of a perfect explosion diaphragm mechanism and an acceleration pump, the function (3) by means of all of the above mechanisms, and the function (4) by means of a heater for heating the choke valve operating bimetal.

After engine warming-up operation, the requisite functions are (1) to supply a mixture of a constant fuel density regardless of throttle opening changes, (2) to supply a mixture of a suitable fuel density if the engine is accelerated or decelerated, and (3) to supply a power mixture if the engine is under high loads. The function (1) has been accomplished by means of an oxygen sensor for feedback control of the air-fuel ratio, the function (2) by means of an acceleration pump and a deceleration device, and the function (3) by means of a power mixture supply mechanism.

It can be seen from the foregoing that various means have been used to control the air-fuel ratio in accordance with engine operation, which results in a complex and expensive carburettor.

Electronic controlled carburettors have been proposed in the art which comprise an oxygen sensor such as, for example, a zirconia oxygen sensor provided in the exhaust system of the engine for detecting the oxygen density of the exhaust gases discharged over it to derive the fuel-air ratio of the mixture having been supplied to the engine for feedback control of the air-fuel ratio. However, such conventional electronic controlled carburettors have been intended to maintain the air-fuel ratio at a level regardless of engine operating condition.

SUMMARY OF THE INVENTION

It is therefore one object of the present invention to provide an air-fuel ratio control system which can control the air-fuel ratio of a mixture supplied to an engine to an optimum level corresponding to the condition under which the engine is operating.

Another object of the present invention is to provide an air-fuel ratio control system of the character described which is remarkably simple in structure and inexpensive in design.

According to the present invention, these and other objects are accomplished by an air-fuel ratio control system for use with an engine carburettor including an air-fuel induction passage provided therein with a throttle valve, a float chamber, and a main fuel passage connected at its one end to the float chamber and at the other end to the induction passage downstream of the throttle valve, the control system comprising a control circuit responsive to various engine operating factors for deriving the condition under which the engine is operating and providing first and second pulse signals each having a constant period and a pulse width corresponding to the derived engine operating condition, a main control valve provided in the main fuel passage, the main control valve responsive to the first pulse signal for opening and closing the main fuel passage so as to control the flow of fuel passing therethrough, fuel supply means for supplying fuel, an auxiliary fuel passage connected at its one end to the fuel supply means and at the other end to the induction passage downstream of the throttle valve, and an auxiliary control valve provided in the auxiliary fuel passage, the auxiliary control valve responsive to the second pulse signal for opening and closing the auxiliary fuel passage so as to control the flow of fuel passing therethrough, thereby providing an optimum air-fuel ratio corresponding to the engine operating condition.

Other objects, means, and advantages of the present invention will become apparent to one skilled in the art thereof from the following description.

DESCRIPTION OF THE PREFERRED EMBODIMENTS

Figure 1:
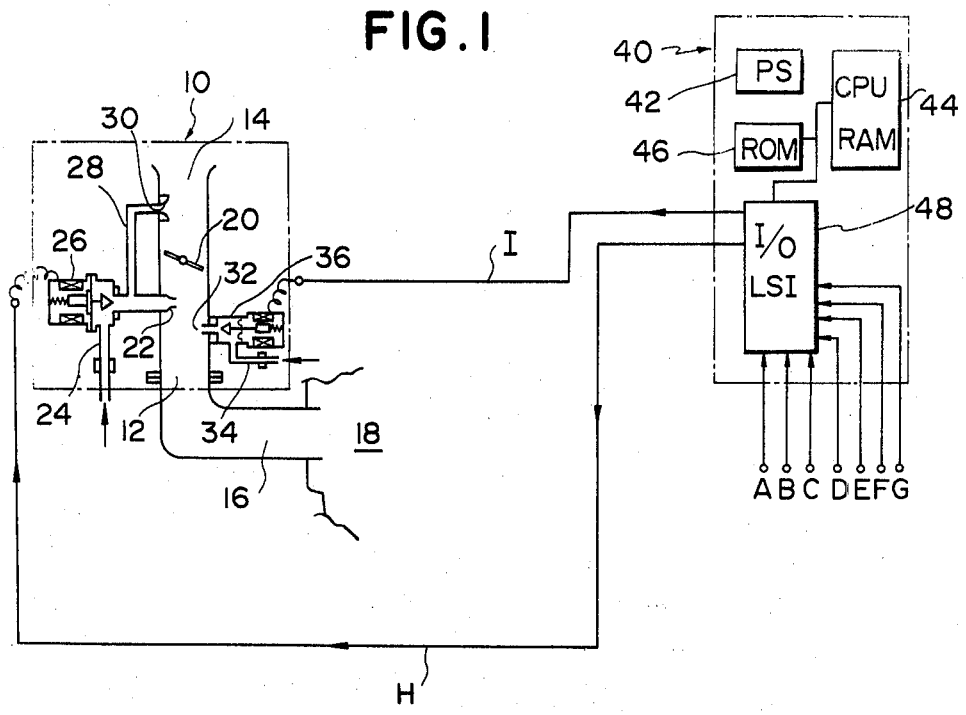
FIG. 1 is a schematic view showing one embodiment of an air-fuel ratio control system constructed in accordance with the present invention.

Referring now to FIG. 1, there is illustrated one embodiment of an air-fuel ratio control system made in accordance with the present invention. The air-fuel ratio control system comprising an electronic controlled carburettor 10 including an air-fuel induction passage 12 with an atmospheric air inlet 14 at one end and connected to the intake manifold 16 of an internal combustion engine 18. The induction passage 12 contains a throttle valve 20. Opening into the passage 12 downstream of the throttle valve 20 is a main atomizer 22 which is connected through a main fuel passage 24 to a float chamber (not shown). The main fuel passage 24 contains a main fuel flow control valve 26 in the form of an on-off operation type electromagnetic valve and is connected at a point downstream of the main fuel control valve 26 to an air passage 28 leading to an air bleed 30 opening into the passage 12 upstream of the throttle valve 20. In this arrangement, fuel is injected through the main atomizer 22 into the induction passage under engine suction vacuum and the amount of fuel injected through the main atomizer 22 is controlled by the main fuel flow control valve 26. Furthermore, air is introduced through the air passage 28 and mixed with the fuel flowing through the main fuel passage 24 to promote fuel fine division and atomization upon fuel injection.

An auxiliary atomizer 32 opens into the induction passage 12 at a point downstream of the throttle valve 20 and opposite to the main atomizer 22. The auxiliary atomizer 32 is connected through an auxiliary fuel passage 34 to an electromagnetic fuel pump (not shown). The auxiliary fuel passage 34 contains an auxiliary fuel flow control valve 36 in the form of an on-off operation type electromagnetic valve. In this arrangement, fuel is injected through the auxiliary atomizer 32 into the induction passage 12 by the pressure of the fuel pressurized by the electromagnetic fuel pump and the engine suction vacuum appearing in the induction passage downstream of the throttle valve 20. The amount of the fuel injected through the auxiliary atomizer 32 is controlled by the auxiliary fuel flow control valve 36.

The air-flow ratio control system also comprises a control unit 40 which includes a power source 42, a central processing unit (CPU) 44 including a random access memory, a read-only memory 46, and an input-/output signal converter 48. The input/output signal converter 48 has various inputs A to G from throttle opening, intake air temperature, cooling water temperature, crankshaft angle, crankshaft position, engine speed, and transmission position sensor, respectively. The input/output signal converter 48 converts the input signals fed thereto from these various sensors into such a form that the CPU 44 can process them and supplies them to the CPU 44. The read-only memory 46, storing reference data, is responsive to the signals A to G for judging the condition under which the engine is operating, such as, for example, starting, rapid acceleration, or rapid deceleration. The read-only memory 46 supplies the data to the CPU 44 which judges the engine operating condition and provides an output signal corresponding to the engine operating condition to the input/output signal converter 48 where the input signal is converted to first and second control signals H and I. The first control signal H is applied to the main fuel flow control valve 26 for operating it and the second control signal I is applied to the auxiliary fuel flow control valve 36 for operating it. That is, the control unit 40 is responsive to various engine operating factor indicative signals A to G for judging the condition under which the engine is operating and providing first and second control signals H and I to the main and auxiliary fuel flow control valves 26 and 36 so as to control the flow of fuel discharged into the induction passage 12 thereby providing an optimum air-fuel ratio corresponding to the engine operating condition.

The operation of the air-fuel ratio control system constructed as described above in accordance with the present invention will now be described.

During engine starting operation, the control unit 40 is responsive to the engine operating factor indicative signals A to G to judge the engine starting condition and provide a second control signal I to the auxiliary fuel flow control valve 36 so as to increase the degree of opening of the valve 36 thereby providing an air-fuel mixture relatively rich sufficient to assure perfect explosion. In this case, since the throttle valve 20 is in its idling position and the engine suction vacuum is low, a little amount of fuel, not pressurized, it supplied through the main fuel passage 24. Thus, the control unit 40 also provides a first control signal H to the main fuel flow control valve 26 so as to close the valve 26. After perfect explosion, the control unit 40 is responsive to the intake air or cooling water temperature indicative signal B or C to provide a second control signal I to the auxiliary fuel flow control valve 36 so as to gradually reduce the degree of opening of the control valve 36 thereby rarefying the mixture as the engine is warmed up. At the end of the engine warming-up operation, the control unit 40 provides a second signal I to the auxiliary fuel flow control valve 36 so as to provide an air-fuel mixture capable of maintaining the engine at idling speed. Since the carburettor 10 is automatically controlled during engine starting operation, there is no need for the driver to operate the accelerator.

During engine idling operation, the control unit 40 is responsive to the engine operating factor indicative signals A to G to judge the engine idling condition and provide a first signal H to the main fuel flow control valve 26 so as to close it and also a second control signal I to the auxiliary fuel flow control valve 36 so as to provide an air-fuel mixture capable of maintaining the engine at idling speed.

When also acceleration is made during normal operation, the control unit 40 provides a second signal I to the auxiliary fuel flow control valve 36 so as to close it and also a first control signal H to the main fuel flow control valve 26 so as to provide an air-fuel mixture having an air-fuel ratio always held at an ideal level. When rapid acceleration is made during normal operation, the control unit 40 provides a second control signal I to the auxiliary fuel flow control valve 36 so as to open it thereby enriching the air-fuel mixture. When slow deceleration is made during normal operation, the control unit 40 provides a first control signal H to the main fuel flow control valve 26 so as to stop the flow of fuel for the purpose of fuel economy.

When the engine is under high loads, the control unit 40 is responsive to the engine operating factor indicative signals A to G to provide first and second control signals H and I to the main and auxiliary fuel flow control valves 26 and 36, respectively, so as to increase the degrees of opening of the control valves thereby providing a power mixture rather richer than the ideal air-fuel ratio.

Each of the first and second control signals H and I for controlling the degrees of opening of the on-off operation type main and auxiliary fuel flow control valves 26 and 36 may be in the form of a pulse signal having a constant period and a pulse width varied in accordance with the condition under which the engine is operating.

It is to be noted that a pressurizer may be provided for pressurizing the fuel flowing through the main fuel passage 24. This permits air-fuel ratio control according to engine operating condition without the use of the auxiliary fuel supply system.

Figure 2:
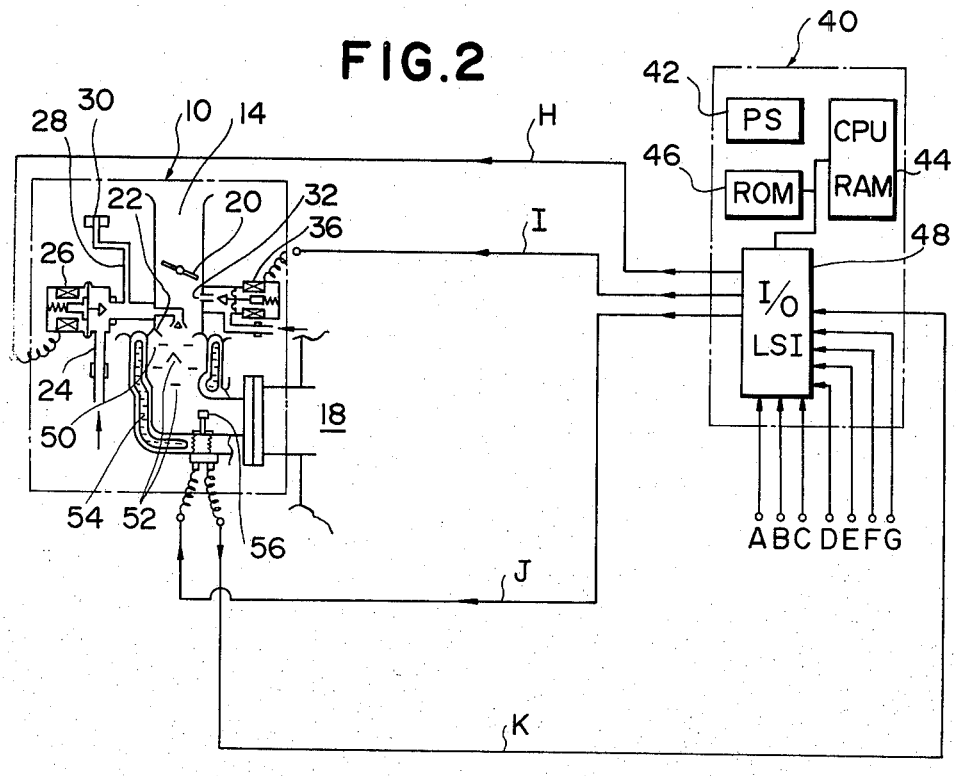
FIG. 2 is a schematic view showing a second embodiment of the present invention.

Referring to FIG. 2, there is illustrated a second embodiment of the present invention which is substantially similar to the first embodiment of FIG. 1 except for the following respects. In this embodiment, the main atomizer 22 is directed downwardly in the center of the induction passage 12. The induction passage 12 has its downstream position increased in diameter to form a mixing chamber 50. A number of plates 52 are arranged within the mixing chamber for increasing air-fuel mixing efficiency and a hot water reservoir 54 is provided to surround the outer periphery of the mixing chamber 50 for heating and atomizing the fuel adhering on the inner surface of the mixing chamber 50. Provided in the induction passage 12 downstream of the mixing chamber 50 is an air-fuel ratio sensor 56 for detecting the air-fuel ratio of the mixture flowing over it to provide an air-fuel ratio indicative signal to the control unit 40.

Figure 3:
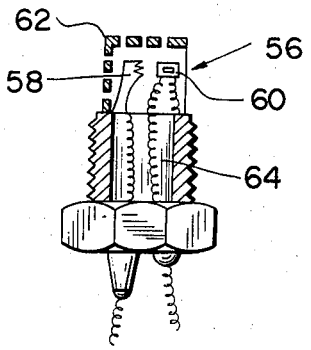
FIG. 3 is an enlarged sectional view of the air-fuel ratio sensor transducer used in the second embodiment of FIG. 2.

FIG. 3 illustrates in more detail the air-fuel ratio sensor 56 which comprises a heater 58, an oxygen sensitive element 60, and a perforated flame stabilizing cover 62 covering the heater 58 and the oxygen sensitive element 60. The heater 58 is responsive to a signal J fed from the control unit 40 for catalytic oxidization of the mixture entering through the holes of the flame stabilizing cover 62 and the oxygen sensitive element 60 detects the oxygen density of the resulting gases to provide an air-fuel ratio indicative signal K to the control unit 40. The lead wires connected to the heater 58 and the oxygen sensitive element 60 are insulated by a heat-resistive insulator 64.

The heater 58 is formed of material having strong catalytic action with hydrocarbons such as fuel and may be taken in the form of a platinum wire or a platinum and/or palladium film deposited on the surface of a member having a shape like a glow plug for use in Diesel engines. The heater 58 is supplied with electric current to have a surface temperature of 300° C. or more for catalytic action. Preferably, the flame stabilizing cover 62 has its inner surface having catalytic action. The flame stabilizing cover 62 serves to protect local combustion of the mixture and promote passage of the mixture to stabilize the combustion. It was ascertained through experiments that the local combustion cannot expand over the whole mixture. Preferably, the heater 58 is made to have a small heat capacity so that the local combustion can be stopped immediately when the electric current to the heater 58 is cut off. For this purpose, the heater 58 may be taken in the form of a thin platinum wire.

In the second embodiment, the control unit 40 is responsive to various engine operating factor indicative signals A to G to provide control signals H and I to the main and auxiliary fuel flow control valves 26 and 36 so as to provide an optimum air-fuel ratio corresponding to the engine operating condition. The air-fuel ratio sensor 56 detects the axtual air-fuel ratio of the mixture supplied to the engine and provides an air-fuel ratio indicative signal to the control unit 40 for feedback control of the air-fuel ratio. Thus, it is possible to provide an optimum air-fuel ratio corresponding to the engine operating condition even if changes occur in valve and atomizer characteristics with time.

Figure 4:
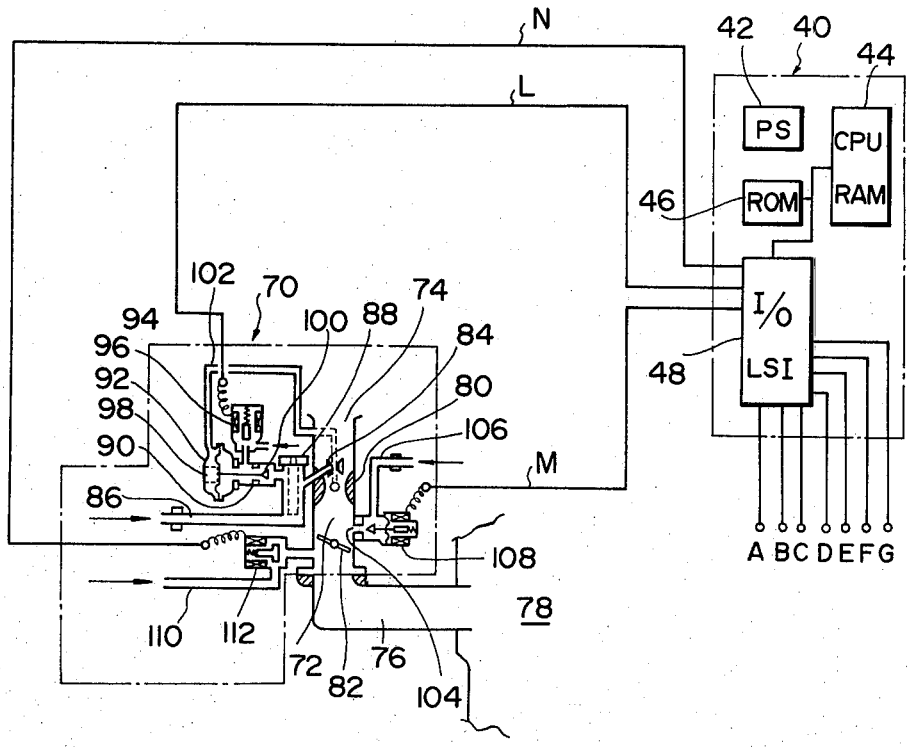
FIG. 4 is a schematic view showing a third embodiment of the present invention.

Referring to FIG. 4, there is illustrated a third embodiment of an air-fuel ratio control system 70 made in accordance with the present invention. The air-fuel ratio control system 70 comprises an air-fuel induction passage 72 with an atmospheric air inlet 74 at one end and connected at the other end to the intake manifold 76 of the engine 78. The induction passage 72 contains a fixed area venturi 80 and a throttle valve 82. Opened into the venturi 80 is a main nozzle 84 which is connected to a main fuel passage 86. The main fuel passage 86 contains a main air bleed 88 and a variable air bleed 90. The variabe air bleed 90 includes a diaphragm type control valve 92 and a main fuel flow correcting valve 94 in the form of an on-off operation type electromagnetic valve. The diaphragm type control valve 92 comprises a diaphragm 96 extending across the interior of a valve housing to provide a vacuum chamber 98, and a valve element 100 coupled through a valve stem to the diaphragm 96. The vacuum chamber 98 is connected through a venturi vacuum introduction passage 102 to the venturi 80 so that the flow of air supplied from the variable air bleed 90 can be controlled in accordance with venturi vacuum. The main fuel flow correcting valve 94 is responsive to a main air flow control signal L for controlling the flow of air supplied therethrough. That is, the amount of air discharged from the variable air bleed 90 and mixed with fuel is controlled in accordance with the venturi vacuum and main air flow control signal L.

Opened into the induction passage 72 at a point just above and in close proximity to the throttle valve 82 is an auxiliary fuel nozzle 104 which is connected to an auxiliary fuel passage 106. The auxiliary fuel passage 106 contains an auxiliary fuel flow control valve 108 in the form of an on-off operation type electromagnetic valve. The auxiliary fuel flow control valve 108 is responsive to an auxiliary fuel flow control signal M for controlling the amount of fuel supplied through the auxiliary fuel passage 106.

An air passage 110 is opened at its one end into the induction passage 72 at a point just below and in close proximity to the throttle valve 82 and connected at the other end to an air cleaner (not shown). The air passage 110 contains an air flow control valve 112 in the form of an on-off operation type electromagnetic valve. The air flow control valve 112 is responsive to an air flow control signal N for controlling the amount of air supplied through the air passage 110.

In this embodiment, the control unit 40 is responsive to various engine operating factor indicative signals A to G for judging the condition under which the engine is operating and providing a main air flow control signal L to the main fuel flow correcting valve 94, an auxiliary fuel flow control signal M to the auxiliary fuel flow control signal M to the auxiliary fuel flow control valve 108, and an air flow control signal N to the air flow control valve 112 so as to provide an optimum air-fuel ratio corresponding to the engine operating conditions.

The operation of the air-fuel ratio control system of the third embodiment of the present invention will now be described.

During engine starting operation, the control unit 40 is responsive to the engine operating factor indicative signals A to G to judge the engine starting condition and provide an auxiliary fuel flow control signal M to the main fuel flow control valve 108 so as to increase the amount of fuel supplied through the auxiliary fuel passage 106 thereby producing an air-fuel mixture richer than the mixture produced during normal operation. If the intake air temperature is low, the control unit 40 provides an auxiliary fuel flow control signal M to the auxiliary fuel flow control valve 108 so as to produce a much richer mixture and simultaneously an air flow control signal N to the air flow control valve 112 so as to provide an increased amount of air sufficient for perfect explosion. After engine starting operation, the control unit 40 is responsive to the intake air or cooling water temperature indicative signal B or C to provide an auxiliary fuel flow control signal M to the auxiliary fuel flow control valve 108 so as to maintain the engine at a suitable idling speed thereby preventing the engine from stalling and also an air flow control signal N to the air flow control valve 112 so as to rarefy the mixture thereby maintaining the engine at an idling speed accomplished during normal operation. Since the carburettor 70 is automatically controlled during engine starting operation, there is no need for the driver to operate the accelerator. In this case, the throttle valve 82 is in its idling position.

When the throttle valve 82 is rapidly opened from the idling position during or after engine warmingup operation, i.e., during acceleration, the control unit 40 provides an auxiliary fuel flow control signal M to the auxiliary fuel flow control valve 108 so as to enrich the air-fuel mixture. When the throttle valve is rapidly closed, i.e., during deceleration, the control unit 40 provides an auxiliary fuel flow control signal M to the auxiliary fuel flow control valve 108 so as to rarefy the air-fuel mixture or fully close the auxiliary fuel passage 106.

If the throttle valve 82 is rapidly opened to accelerate the engine at the end of the deceleration operation, fuel is rapidly burned to cause a shock. The control unit 40 provides an auxiliary fuel flow control signal M to the auxiliary fuel flow control valve 108 so as to gradually increase the amount of the fuel supplied through the auxiliary fuel passage 106 thereby reducing the shock.

When the engine is under high loads, the control unit 40 provides a main air flow control signal L to the main fuel flow correcting valve 94 so as to decrease the amount of air supplied from the variable air bleed 90 and mixed with fuel and also an auxiliary fuel flow control signal M to the auxiliary fuel flow control valve 108 so as to increase the amount of fuel supplied through the auxiliary fuel passage 106 thereby providing a power mixture having an air-fuel ratio richer than the stoichiometric level.

The diaphragm type control valve 92 is responsive to venturi vacuum to control the amount of air discharged from the variable air bleed 90 and mixed with fuel such as to reduce it with an increase in venturi vacuum.

Since the air-fuel ratio of the mixture supplied to the engine is controlled to some extent mechanically and controlled to a less extent by the electronic controlled section including the auxiliary fuel supply system, the auxiliary air supply system and the main fuel flow correcting valve, the amount of fuel and air supplied through the electronic controlled system is relatively small. Accordingly, the electronic controlled carburettor 70 is high in responsibility to transient operation characteristics and can provide an air-fuel ratio capable of operating the engine without any great hindrance even if the electronic controlled section gets out of order.

Each of the control signals, L M and N may be in the form of a pulse signal having a constant period and a pulse width varied in accordance with the condition under which the engine is operating.

The present invention as thus described embodies a simple and inexpensive air-fuel ratio control system for controlling the air-fuel ratio of a mixture supplied to an engine to an optimum level corresponding to the condition under which the engine is operating. It is to be understood that the scope of the present invention is not to be restricted to the embodiments above described but rather, in view of the numerous modifications and changes which will readily occur to those skilled in the art, the scope of the present invention is set forth in the appended claims.

What is claimed is:

1. An air-fuel ratio control system for use with an engine carburetor including an air-fuel induction passage provided therein with a throttle valve, a float chamber, and a main fuel passage connected at its one end to said float chamber and at the other end to said induction passage downstream of said throttle valve, comprising:

(a) a control unit responsive to various engine operating factors for judging the condition under which the engine is operating and providing first and second pulse signals each having a constant period and a pulse width corresponding to the engine operating condition;

(b) a main control valve provided in said main fuel passage, said main control valve responsive to the first pulse signal for opening and closing said main fuel passage so as to control the flow of fuel passing therethrough;

(c) fuel supply means for supplying fuel;

(d) an auxiliary fuel passage connected at its one end to said fuel supply means and at the other end to said induction passage downstream of said throttle valve;

(e) an auxiliary control valve provided in said auxiliary fuel passage, said auxiliary control valve responsive to the second pulse signal for opening and closing said auxiliary fuel passage so as to control the flow of fuel passing therethrough, thereby providing an optimum air-fuel ratio corresponding to the engine operating condition; and (f) an air-fuel ratio sensor provided in said induction passage downstream of said throttle valve, said sensor responsive to the air-fuel ratio of a mixture flowing thereover to provide an air-fuel ratio indicative signal to said control unit for feedback control of the air-fuel ratio, said air-fuel ratio sensor comprises a heater responsive to a signal from said control unit for catalytic oxidization of the mixture flowing into contact therewith, an oxygen sensitive element for detecting the oxygen density of the gases resulting from the catalytic oxidization, and a perforated flame stabilizer covering said heater and said oxygen sensitive element.

2. An air-fuel ratio control system according to claim 1, wherein said heater is in the form of a platinum and/or palladium film.

3. An air-fuel ratio control system according to claim 1, wherein said heater is in the form of a platinum wire.

4. An air-fuel ratio control system according to claim 1, wherein said induction passage has its diameter increased just above said air-fuel ratio sensor to provide a mixing chamber and plates are arranged within said mixing chamber for providing high air-fuel mixing effect.

5. An air-fuel ratio control system according to claim 7, which further comprises a hot water reservoir surrounding the outer periphery of said mixing chamber for heating and atomizing the fuel adhering on the inner surface of said mixing chamber.

* * * * *